US006220881B1

(12) United States Patent
Murakami et al.

(10) Patent No.: US 6,220,881 B1
(45) Date of Patent: Apr. 24, 2001

(54) CARD EDGE CONNECTOR

(75) Inventors: Takao Murakami; Masaya Yamamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/280,008

(22) Filed: Mar. 29, 1999

(30) Foreign Application Priority Data

Mar. 31, 1998 (JP) ..... 10-087538

(51) Int. Cl.[7] ..... H01R 13/15; H01R 13/62; H01R 24/00

(52) U.S. Cl. ..... 439/262; 439/329; 439/637

(58) Field of Search ..... 439/329, 67, 267, 439/260, 262, 637

(56) References Cited

U.S. PATENT DOCUMENTS 5,489,216 * 2/1996 Matsushita et al. ..... 439/260
5,528,853 * 6/1996 Dufaux et al. ..... 43/62
5,632,638 * 5/1997 Matsushita et al. ..... 439/260

FOREIGN PATENT DOCUMENTS 8-37066 2/1996 (JP) .

* cited by examiner

*Primary Examiner*—Lincoln Donovan
(74) *Attorney, Agent, or Firm*—Armstrong, Westerman, Hattori, McLeland & Naughton, LLP

(57) ABSTRACT

A card edge connector is provided. This card edge connector comprises: a first connector housing and a second connector housing to be inserted into a connector receiving chamber provided with a wiring substrate having terminal connecting portions; a plurality of terminals each having an elastic contact segment provided with a contact portion; assisting members (spring members) for helping the elastic contact segments to resist separation of the first connector housing and the second connector housing in the connector receiving chamber; and a holding mechanism provided to the first connector housing and the second connector housing for holding the assisting members by engaging them with the rotary support axes and the bearings.

5 Claims, 4 Drawing Sheets

CARD EDGE CONNECTOR

BACKGROUND OF THE INVENTION

1. Field of the Invention

The present invention relates to a card edge connector which is inserted into a connector receiving chamber provided with a wiring substrate having a plurality of rectangular terminal connecting portions disposed in predetermined positions on both front and rear surfaces of the wiring substrate, and into which a plurality of terminals each having an elastic contact segment to be in contact with a terminal contact portion via the opening of a corresponding terminal receiving chamber are inserted.

2. Description of the Related Art

A card edge connector shown in FIG. 6 has been widely known. The card edge connector 1 of FIG. 6 includes terminals 5 each having elastic contact segment 4 inserted into terminal receiving chambers 3 and 3' on the upper side and the lower side of a rectangular connector housing 2. The card edge connector 1 is to be inserted into a connector receiving chamber 7 provided with a wiring substrate 6 in the middle.

In the middle of the connector housing 2, a space 8 for separating the terminal receiving chambers 3 and 3' and into which the wiring substrate 6 is inserted is provided. The terminal receiving chambers 3 and 3' are provided with openings 9 and 9' communicating with the space 8, respectively.

Each of the terminals 5 is made of a conductive metal material, and comprises an elastic contact segment 4 and a wire connecting portion 11 to which a wire 10 is connected by caulking. The elastic contact segment 4 is provided with a contact portion 12 protruding from the openings 9 and 9' by a predetermined length. The contact portion 12 is situated in the middle of the bent portion.

The connector receiving chamber 7 is formed by caving a device casing 13 so as to accommodate the connector housing 2. Both front and rear surfaces of the wiring substrate 6 are provided with a plurality of rectangular terminal connecting portions (not shown) sandwiched by the elastic contact segments and in contact with the contact portions one by one.

When the card edge connector 1 is inserted into the connector receiving chamber 7, each of the elastic contact segments 4 is brought into contact with corresponding one of the terminal connecting portions and bent by the front surface or the rear surface of the wiring substrate 6, so that electric connection can be obtained.

In the prior art, due to variations in lengths A, B, C, and D indicated in FIG. 6 (length A is the thickness of the wiring substrate 6, inclusive of the thickness of the terminal connecting portions; length B is the distance between two facing contact portions 12; length C is the distance between the inner walls of the connector receiving chamber 7; and length D is the height of the connector housing 2 in the direction corresponding to the length C), the contact load of the respective elastic contact segments against the respective terminal connecting portions cannot be stabilized, which might result in a fault in electric contact.

Since the device casing 13, the connector receiving chamber 7, and the connector housing 2 are all made of a synthetic resin material, they are liable to be adversely affected by a change in the environment. When they are used at a high temperature, the length C of the connector receiving chamber 7 and the length D of the connector housing 2 are increased, with the elastic contact segments 4 being in contact. As the increased amount becomes larger, the contact load becomes smaller.

Meanwhile, the elastic contact segments 4 are limited in terms of width, thickness, and flexibility, due to the limited spaces in the terminal receiving chamber 3 and 3' and the space 8. Moreover, only limited types of material can be used for the elastic contact segments 4, in view of conductive efficiency. As a result, it becomes difficult to absorb the contact load by adjusting the lengths, and a fault occurs in electric contact.

SUMMARY OF THE INVENTION

The principal object of the present invention is to provide a card edge connector which can ensure stable contact between terminal connecting portions of a wiring substrate and elastic contact segments.

In accordance with a first aspect of the present invention, the card edge connector comprises a first connector housing, a second connector housing, a plurality of terminals, an assisting unit, and a holding mechanism. The first connector housing is to be received by either the front surface or the rear surface of a wiring substrate of a connector housing. The first connector housing has a plurality of first terminal chambers and first openings communicating with the plurality of first terminal chambers. The wiring substrate has a plurality of rectangular terminal connecting portions disposed in predetermined positions on the front surface and the rear surface. The first openings face the surface receiving the first connector housing. The second connector housing is to be received by either the front surface or the rear surface of the wiring substrate whichever does not receive the first connector housing. The second connector housing has a plurality of second terminal chambers and second openings communicating with the second terminal chambers. The second openings face the surface receiving the second connector housing. The plurality of terminals are to be inserted into the first terminal chambers and the second terminal chambers. Each of the terminals is provided with a wire connecting portion and an elastic contact segment having a contact portion to be in contact with corresponding one of the terminal connecting portions via corresponding one of the first openings or the second openings. The edge of each elastic contact segment is bent back toward the wire connecting portion. Each of the contact portions is formed in the middle of the bent portion of the corresponding elastic contact segment. The assisting unit assists the elastic contact segments in resisting separation of the first connector housing and the second connector housing inside the connector receiving chamber. The holding mechanism holds the assisting unit, and is provided to the first connector housing and the second connector housing. The holding mechanism comprises rotary support axes and bearings for rotatably supporting the first connector housing and the second connector housing.

With this structure, when the card edge connector is inserted into the connector receiving chamber, the wiring substrate is sandwiched by the elastic contact segments pressing its front and rear surfaces. The elastic contact segments are brought into contact with the terminal connecting portions and flexed to press them, thereby obtaining electric connection. Meanwhile, the assisting unit resists separation of the first connector housing and the second connector housing inside the connector receiving chamber, so as to assist the elastic contact segments in securing required contact load. Even if there is a length variation between the inner walls of the connector receiving chamber, or even if the elastic contact segments wear with time, the assisting unit maintain the contact load required between the contact portions and the terminal connecting portions.

As the contact load of the elastic contact segments against the terminal connecting portions of the wiring substrate provided to the connector receiving chamber is stabilized, insufficient contact can be prevented, and high reliability can be expected.

In accordance with a second aspect of the present invention, the assistant unit is made up of spring members each having two arms and a coil to be engaged with the holding mechanism, and each of the coils is formed by rounding the mid section of a metal wire.

With the assisting unit of this structure, when the card edge connector is inserted into the connector receiving chamber, the two arms push in the opposite direction to the separating direction of the first connector housing and the second connector housing by the wiring substrate with the rotary support axes being the center. In such a condition, even if there is a variation in size or length, the assisting unit assists the elastic contact segments to stabilize the contact load. Since the assisting unit does not need to possess a conductive function, a highly durable wire material such as piano wire can be used. Accordingly, the spring members can function as an assisting unit to provide high reliability. The spring members are also advantageous in that they are easy to produce.

In accordance with a third aspect of the present invention, the holding mechanism is provided with arm hooks for receiving the two arms and the rotary support axes to be inserted into the coils.

With the holding mechanism of this structure, the two arms become contractible with respect to the coils. As the spring members assist the elastic contact segments within the area determined by the arm hooks, the distribution of the contact load can be controlled by adjusting the positions of the arm hooks. Also, since the holding mechanism has a simple structure, it has no adverse influence on the manufacturing the first and second connector housings.

In accordance with a fourth aspect of the present invention, the assistant unit is a spring member comprising two coils to be engaged with the holding mechanism, a crossover disposed between the two coils, and two arms facing to each other and extending from the respective two coils. The two coils are formed by rounding two portions of a metal wire.

When the card edge connector is inserted into the connector receiving chamber of the above structure, the two arms and the crossover resist the separation of the first connector housing and the second connector housing by the wiring substrate with the rotary support axes being the center. Even if there is a variation in size or length, the assisting unit assists the elastic contact segments so as to constantly stabilize the contact load. Also, since the assisting unit has no need to have conductive properties, a highly durable material having a high allowable stress, such as piano wire, can be used for the assisting unit. Thus, the spring members can sufficiently function as an assisting unit, thereby providing high reliability. The spring members are also advantageous in that they are easy to produce.

In accordance with a fifth aspect of the present invention, the holding mechanism is provided with arm hooks for receiving the rotary support axes to be inserted into the respective coils, and a crossover hook for receiving the crossover.

With the holding mechanism of this structure, the two arms and the crossover are contractible with respect to the coils. As the spring members assist the elastic contact segments within the area determined by the arm hooks, the distribution of the contact load can be controlled by adjusting the positions of the arm hooks. Also, since the holding mechanism has a simple structure, it has no adverse influence on the manufacturing the first and second connector housings.

The above and other objects and features of the present invention will become more apparent from the following description taken in conjunction with the accompanying drawings.

DESCRIPTION OF THE PREFERRED EMBODIMENTS

The following is a description of one embodiment of the present invention, with reference to the accompanying drawings.

Figure 1:
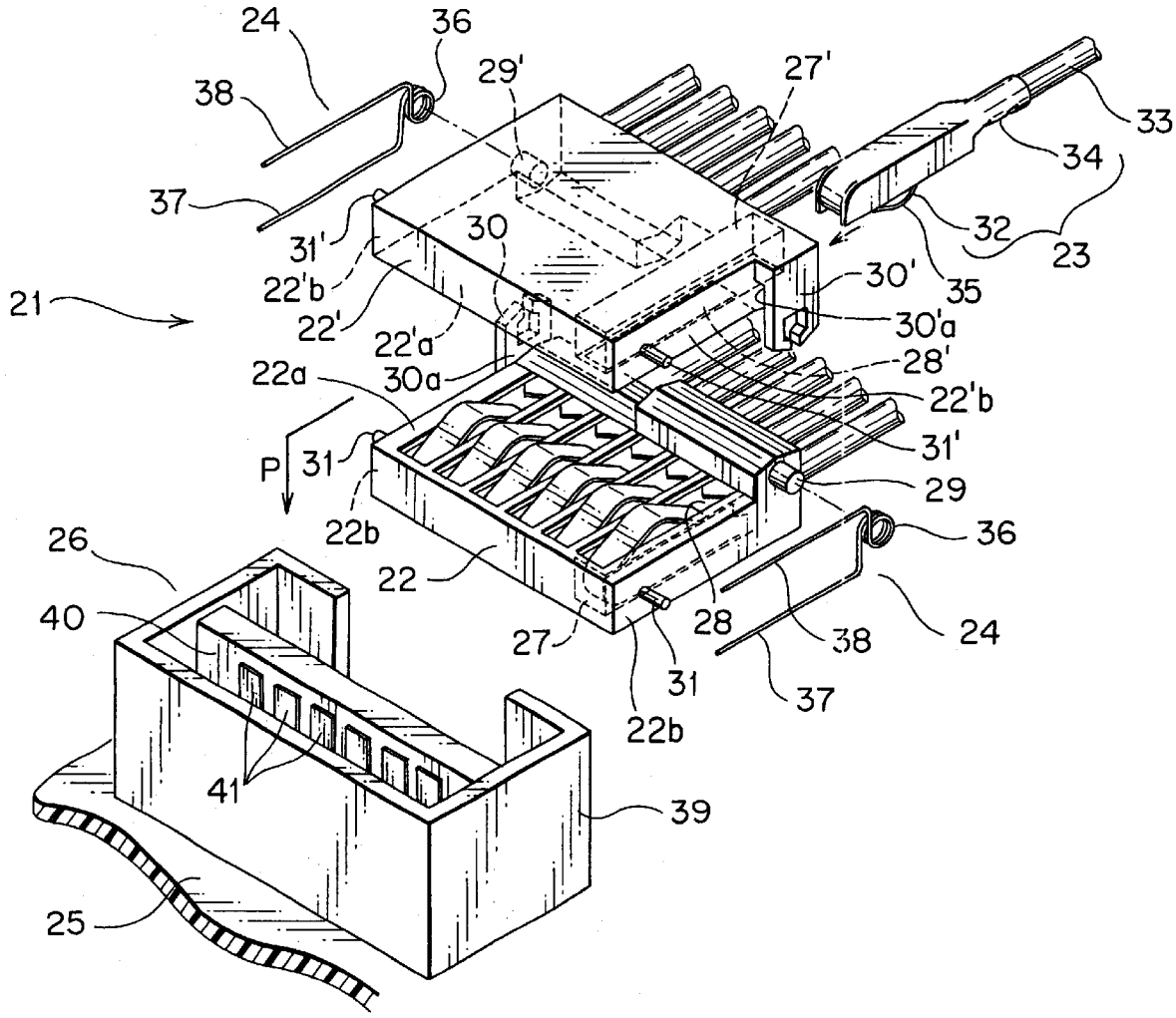
FIG. 1 is. an exploded perspective view of one embodiment of a card edge connector of the present invention.

In FIG. 1, a card edge connector 21 comprises a first connector housing 22 and a second connector housing 22' both made of synthetic resin, a plurality of terminals 23 to be inserted into the first connector housing 22 and the second connector housing 22', and a pair of spring members 24 to be engaged with the first connector housing 22 and the second connector housing 22'. For instance, such a card edge connector is inserted into a connector receiving chamber 26 formed on a device casing 25, so as to obtain electric connection.

The first connector housing 22 and the second connector housing 22' are formed by injection molding to have a rectangular shape. In this embodiment, they have the identical shape and face to each other. Six terminal chambers 27 and six terminal chambers 27' are formed inside the first connector housing 22 and the second connector housing 22', respectively. Each of the terminal receiving chambers 27 and 27' is provided with a known terminal stopper (not shown) such as a lance. Six rectangular openings 28 and six rectangular openings 28 ' communicating with the respective terminal receiving chambers 27 and 27' are formed on the upper walls 22*a* and 22*a'* of the first connector housing 22 and the second connector housing 22' corresponding to the front and rear surfaces of a wiring substrate 40 of the connector receiving chamber 26.

Cylindrical rotary support axes 29 and 29', and bearings 30 and 30' having notches 30*a* and 30*a'* for the spring members 24 and 24' are formed on the rear side of the side surfaces 22*b* and side surfaces 22*b'* of the first connector housing 22 and the second connector housing 22', respectively. A pair of cylindrical arm hooks 31 and another pair of cylindrical arm hooks 31 protruding in the opposite directions are formed on the front side of the side surfaces 22*b* and 22*b'*.

Each of the terminals 23 is formed by stamping out a thin conductive metal plate, and includes an elastic contact segment 32 and a wire connecting portion 34 to which an electric wire 33 is connected by caulking. The edge of the elastic contact segment 32 is bent toward the wire connecting portion 34, and a contact portion 35 to be in contact with a terminal connecting portion 41 of the connecting receiving portion 26 is formed in the meddle of the bent portion via the corresponding opening 28 or 28'.

The pair of spring members 24 are metal wires, and coil portions 36 are formed in the middle of the respective spring members 24. The coil portions 36 have a larger diameter than that of the rotary support axes 29 and 29'. Each of the coil portion 36 is provided with a first arm 37 and a second arm 38 both extending straight. The first arm 37 and the second arm 38 face to each other with the coil portion 36 being the center.

Meanwhile, the connector receiving chamber 26 has a rectangular box-like housing 39 protruding from the device casing 25, and the wiring substrate 40 is disposed in the middle of the housing 39. Since the wiring substrate 40 has a conventional structure, it is not described herein in detail. A plurality of rectangular terminal connecting portions 41 communicating with the respective elastic contact segments 32 are formed on the front and rear surfaces of the wiring substrate 40.

The structure of the wiring substrate 40 is not limited to that of this embodiment, and it is possible to employ a flexible print circuit 43 having terminal connecting portions 42 fixed onto the front and rear surfaces of a substrate 44.

In the following, the process of attaching and inserting the card edge connector 21 into the connector receiving chamber 26 will be described with reference to FIGS. 1 and 2.

As shown in FIG. 1, the terminals 34 are inserted into the respective terminal receiving chambers 27 and 27' of the first connector housing 22 and the second connector housing 22'. Each of the inserted terminals 23 is then held by the terminal stopper (not shown) and the contact portion 35 of the elastic contact segment 32 of each of the terminals 23 protrudes from the corresponding opening 28 or 28'.

Figure 2:
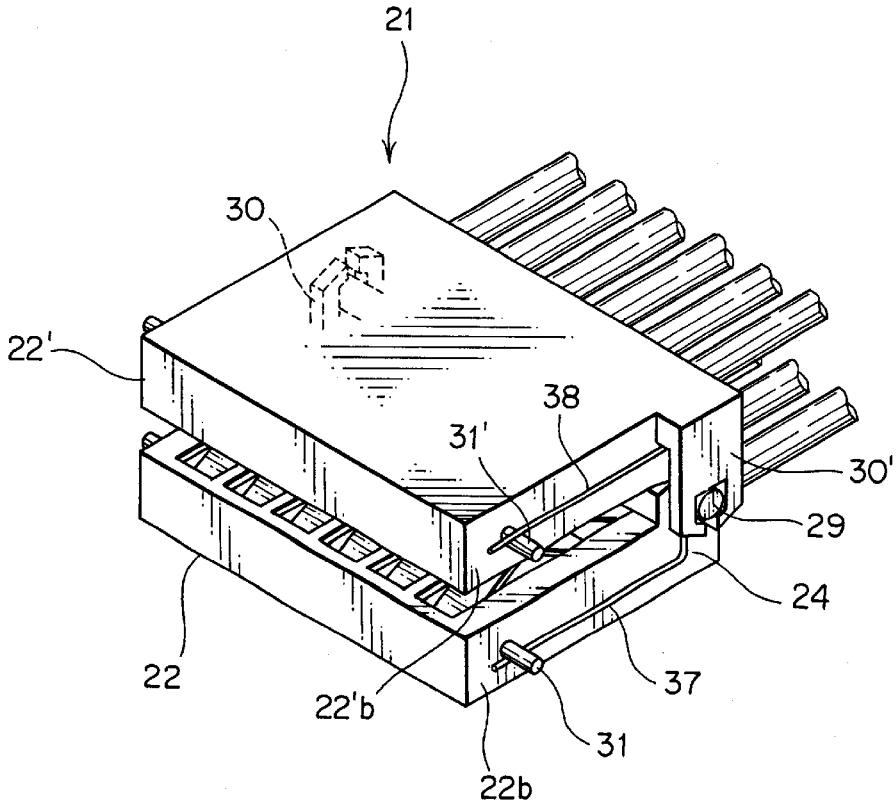
FIG. 2 is an outer perspective view of the card edge connector of FIG. 1.
Figure 3:
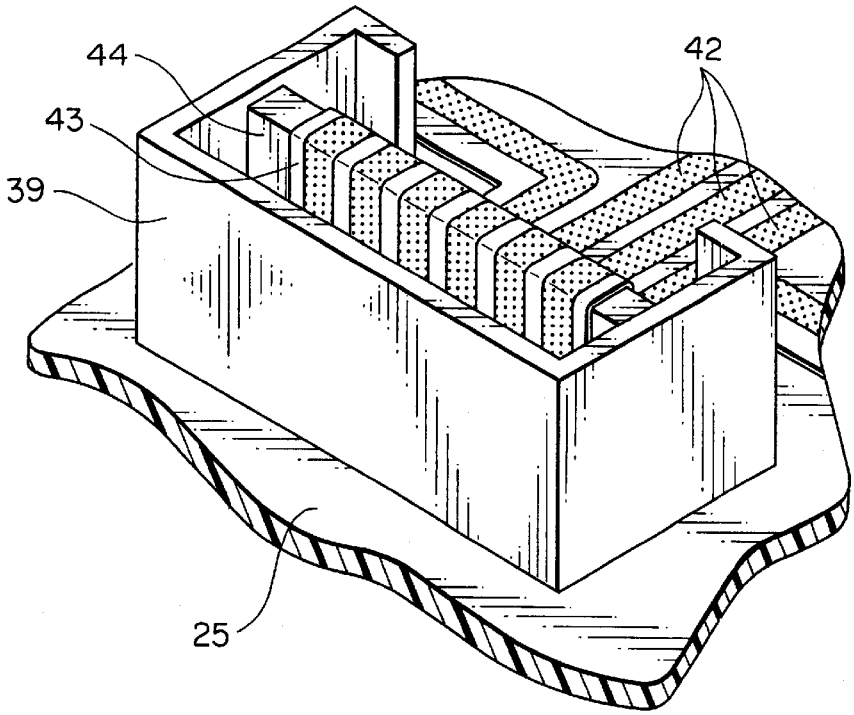
FIG. 3 is a perspective view illustrating another example of the connector receiving chamber of FIG. 1.

As shown in FIG. 2, the pair of spring members 24 are then engaged with the side surfaces **22*b* and 22*b*' of the first connector housing 22 and the second connector housing 22', and the rotary support axes 29 and 29' are engaged with the respective bearings 30 and 30'. More specifically, after the coil portions 36 are inserted into the respective rotary support axes 29 and 29', the rotary support axes 29 and 29' are engaged with the respective bearings 30 and 30', and the first arms 37 are hooked by the outer side of the arm hooks 31. The second arms 38 are pulled and hooked by the outer side of the arm hooks 31 '. Thus, the attachment of the card edge connector 21 is completed, as shown in FIG. 2**.

As the card edge connector 21 is inserted into the connector receiving chamber 26 in the direction of arrow P of FIG. 1, the elastic contact segments 32 sandwich the wiring substrate 40 by the front and rear surfaces. Once the card edge connector 21 is brought into contact with the wiring substrate 40, the wiring substrate 40 starts separating the first connector housing 22 and the second connector housing 22', with the respective rotary support axes 29 and 29' being the center. Here, the spring members 24 resist the separation, and the contact portion of each of the elastic contact segments 32 is in contact with the corresponding terminal connecting portion 41 and elastically pushes it so as to obtain electric connection.

Even if there is a variation in the distance between the upper inner wall and the lower inner wall of the connector receiving chamber 26, in the height of the card edge connector 21, or in the total height of the first connector housing 22 and the second connector housing 22' engaged with each other, or even if the elastic contact segments 32 wear with time, the spring members 24 maintain the contact load between each contact portion 35 and the corresponding terminal connecting portion 41.

Accordingly, the card edge connector 21 can always have a stable contact load, so that faults in contact can be prevented, and high reliability can be obtained.

Figure 4:
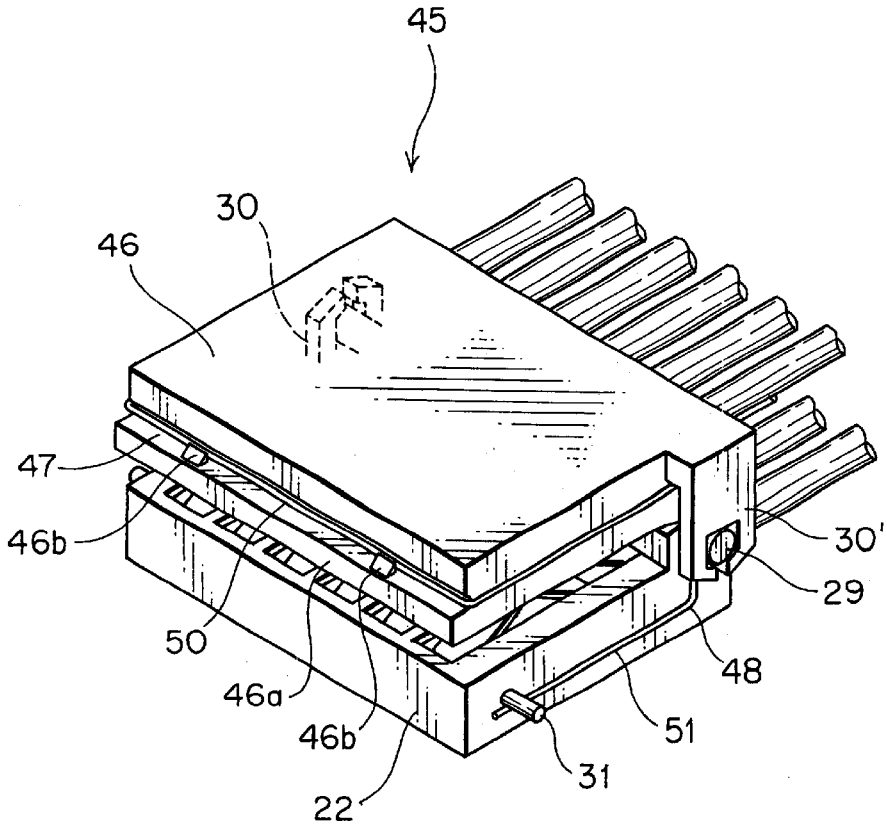
FIG. 4 is an outer perspective view of another embodiment of a card edge connector of the present invention.
Figure 5:
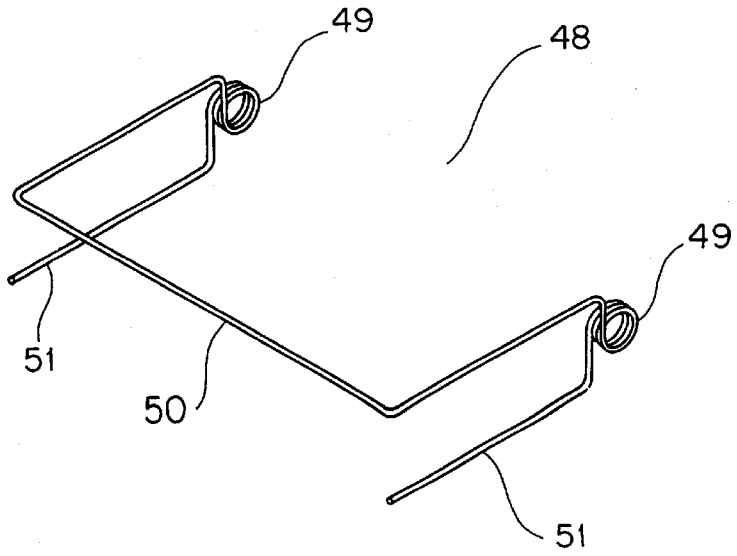
FIG. 5 is an outer perspective view of the spring member of FIG. 4.
Figure 6:
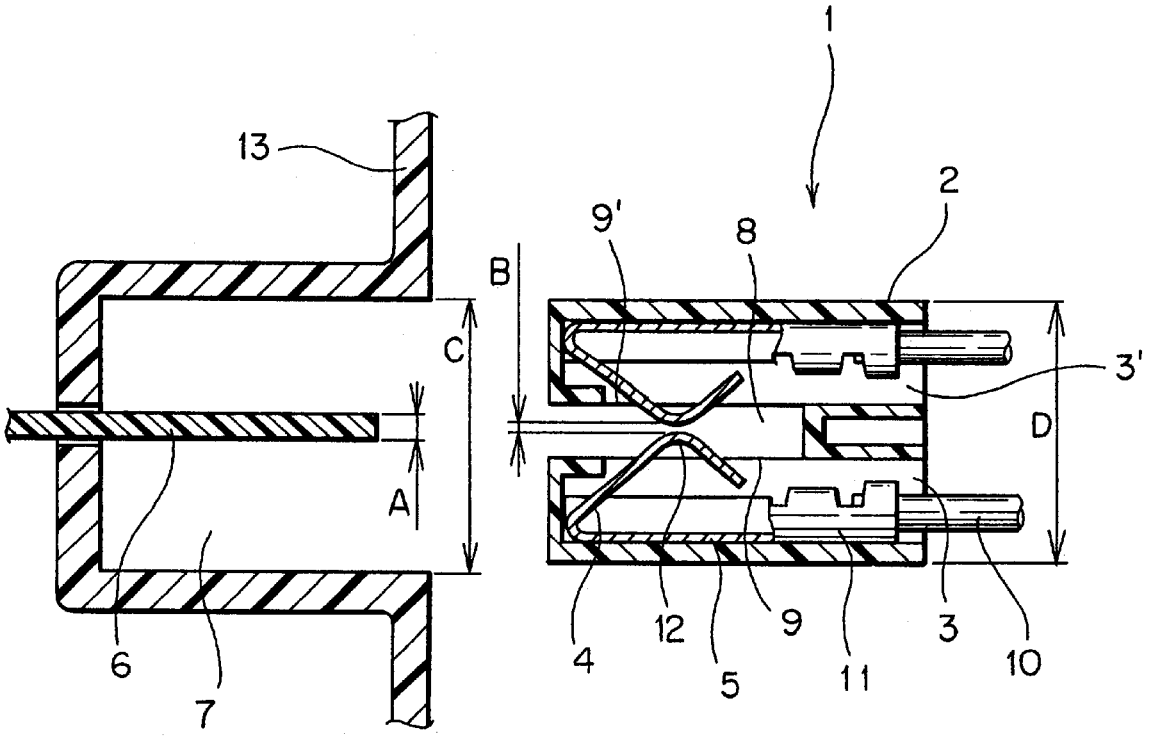
FIG. 6 PRIOR ART
FIG. 6 is a cross-sectional view of a card edge connector of the prior art.

Referring now to FIGS. 4 and 5, the following is a description of another embodiment of the present invention. It should be noted here that like components are indicated by like reference numerals in this embodiment and the foregoing embodiment.

A card edge connector 45 shown in FIG. 4 differs from the card edge connector 21 in the second connector housing 22' and the spring members 24.

Although the second connector housing 22' is provided with the arm hooks 31' in the foregoing embodiment, a second connector housing 46 of this embodiment is provided with a groove-like crossover hook 47, instead of the arm hooks 31', on the front wall 46a of the second connector housing 46.

The front wall **46*a* is formed with a step, and it is preferable for a crossover 50 to provide claws 46*b* to the front wall 46*a*, as shown in FIG. 4. The other structural features are the same as those of the second connector housing 22'**.

Meanwhile, a spring member 48, equivalent to the spring members 24, is a metal wire, and coils 49 having a larger diameter than the rotary support axes 29 and 29' are disposed in such positions that they face to each other, as shown in FIG. 5. The crossover 50 to be hooked by the crossover hook 47 extends from the coils 49, and arms 51 also extend straight from the coils 49.

The card edge connector 45 of this structure can achieve the same effects as the card edge connector 21. The process of attaching and inserting the card edge connector 45 into the connector receiving chamber 26 is the same as with the card edge connector 21.

Since any suitable assisting component provided to resist separation of a first connector housing and a second connector housing can bring the above effects when a card edge connector is inserted into a connector receiving chamber, the structure of a card edge connector of this embodiment is not limited to the card edge connectors 21 and 45. If the assist component is formed from a metal wire spring member, a required contact load for the elastic contact segments can be determined from the spring constant. Also, since such an assist component needs to have no conductive properties, a highly durable material which has a high stress intensity and is hard to wear, such as piano wire, can be employed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A card edge connector, comprising:

a first connector housing to be received by either a front surface or a rear surface of a wiring substrate of a connector housing, the first connector housing having a plurality of first terminal chambers and first openings communicating with the plurality of first terminal chambers, the wiring substrate having a plurality of rectangular terminal connecting portions disposed in predetermined positions on the front surface and the rear surface thereof, and the first openings facing the surface receiving the first connector housing;

a second connector housing to be received by either the front surface or the rear surface of the wiring substrate whichever does not receive the first connector housing, the second connector housing having a plurality of second terminal chambers and second openings communicating with the second terminal chambers, the second openings facing the surface receiving the second connector housing;

a plurality of terminals to be inserted into the first terminal chambers and the second terminal chambers, the plurality of terminals each provided with a wire connecting portion and an elastic contact segment having a contact portion to be in contact with corresponding one of the terminal connecting portions via corresponding one of the first openings or the second openings, an edge of the elastic contact segment being bent back toward the wire connecting portion, and the contact portion being formed in the middle of the bent portion of the elastic contact segment;

assisting means for assisting an electrically connecting action of the elastic contact segment by resisting separation of the first connector housing and the second connector housing inside the connector receiving chamber; and a holding mechanism for holding the assisting means, the holding mechanism being provided to the first connector housing and the second connector housing, and comprising rotary support axes and bearing for rotatably supporting the first connecting housing and the second connector housing, wherein the assistant means consistent of a pair of spring members each having two arms and a coil to be engaged with each of the rotary support axes of the holding mechanism, and said holding mechanism is provided with two pairs of arm hooks, each pair of arm hooks being inwardly engaged by said two arms from outside of said arm hooks.

2. The card edge connector according to claim 1, wherein the coil is formed by rounding a mid section of a metal wire.

3. The card edge connector according to claim 1, wherein the holding mechanism is provided with arm hooks for receiving the two arms and the rotary support axes to be inserted into the coils.

4. The edge connector according to claim 1, wherein the pair of spring members consists of first and second spring members each having a coil to be engaged with the holding mechanism, and wherein a crossover is disposed between first and second spring members and connects one of two arms facing to each other and extending from the coil of the first spring member with one of two arms extending from the coil of the second spring member;

from the first and second members.

5. The card edge connector according to claim 4, wherein the holding mechanism is provided with a crossover hook for receiving the crossover.

* * * * *